US006353933B1

(12) United States Patent
Love

(10) Patent No.: US 6,353,933 B1
(45) Date of Patent: Mar. 12, 2002

(54) COMBINATION STADIUM CUSHION AND PONCHO

(75) Inventor: Larrry W. Love, Columbus, IN (US)

(73) Assignee: Larry W. Love., Columbus, IN (US)

( * ) Notice: Subject to any disclaimer, the term of this patent is extended or adjusted under 35 U.S.C. 154(b) by 0 days.

(21) Appl. No.: 09/717,752

(22) Filed: Nov. 21, 2000

(51) Int. Cl.[7] ..... A41D 3/08
(52) U.S. Cl. ..... 2/88; 2/84
(58) Field of Search ..... 2/88, 84, 86, 69, 2/93, 94, 87, 89

(56) References Cited

U.S. PATENT DOCUMENTS

| | | | |
|---|---|---|---|
| 3,958,274 | A | 5/1976 | Klauber |
| 4,035,606 | A | 7/1977 | Browder |
| 4,060,852 | A | 12/1977 | Meeks |
| 4,138,742 | A | 2/1979 | Meeks |
| 4,370,755 | A | 2/1983 | Crumby |
| 5,414,881 | A | 5/1995 | Terrazas |
| 5,588,749 | A | 12/1996 | Ishikawa |
| 5,870,775 | A | 2/1999 | Noyola |
| 5,884,331 | A | 3/1999 | Barajas |
| 5,946,723 | A | 9/1999 | DiProto et al. |

*Primary Examiner*—Gloria M. Hale
*Assistant Examiner*—Tejash Patel
(74) *Attorney, Agent, or Firm*—Baker & Daniels

(57) ABSTRACT

A poncho and cushion combination is provided for use as protective weather garment while sitting. The poncho is formed from a substantially rectangular sheet with a hood at an opening in the sheet. An extension sheet attaches the cushion to the inside surface of the rear panel of the poncho. In this way, the cushion is protected by the poncho. The cushion is disposed so that it rests slightly below the spectator's buttocks when standing while wearing the poncho. The cushion is then readily available for the spectator to sit down on. The poncho can be folded and rolled onto the extension sheet. The extension sheet can be rolled around the poncho and fastened to the cushion to stow the poncho.

11 Claims, 4 Drawing Sheets

COMBINATION STADIUM CUSHION AND PONCHO

BACKGROUND OF THE INVENTION

The invention relates to a protective garment or poncho in combination with a cushion for a person to sit on. This combination of poncho and cushion is used against unexpected weather during an outing, such as watching an outdoor game or parade.

In order to be well prepared for sudden changes in the weather, spectators to outdoor events usually have to carry a number of items, such as a blanket, raincoat, seat cushion, umbrella, etc. Carrying these items can be inconvenient and bulky. More often than not, the spectator is ill-prepared for changes in weather.

Seats in stadiums and outdoor arenas or amphitheaters are usually uncomfortable. For example, most seats at the stadiums are made of hard plastic or wood material. Seats at amphitheaters are typically bench seats consisting of long flat piece of woods. These seats can be extremely uncomfortable, even numbing, for people to sit on for extended periods. The experience can be made even worse when the spectator has to face unpredictable weather. The day may be sunny and then turn bad at a moment's notice. A downpour may come suddenly leaving the spectators scrambling for raingear, if they have them.

Previous attempts have been made to address some of these problems. Among these attempts are devices shown in U.S. Pat. Nos. 4,060,852 and 4,138,742 issued to Meeks on Dec. 6, 1977 and Feb. 13, 1979, respectively. These two patents disclose the combination of a garment with a cushion. The garment can be folded into the interior of the cushion, which has two halves that open and close similar to a clamshell using either a zipper or a hook and loop fastener. The garments or ponchos in both patents are similar in design, with a body portion, a hood, arm slots and a cushion attached to outside of the poncho.

These two inventions are bulky and the protective garment would take considerable amount of time to put on. A spectator would not be able to put the poncho on while sitting on the cushion, but would instead have to stand up unfasten the cushion, unroll the garment, unbutton the front of the garment, put it on and then button the front of the garment. Then the spectator would have to fasten the two halves of the cushion together before being able to sit back down. By the time this process is complete, the spectator may already be soaking wet from a downpour.

U.S. Pat. No. 4,370,755, issued to Crumby on Feb. 1, 1983, discloses a poncho having an enclosed area at the center of the rear panel. The enclosed area may be inflated to form a cushion for sitting. A spectator would have to inflate the cushion before he or she can sit on it. This process can be time consuming and tiring because a spectator usually has to inflate the cushion by himself. Whenever it rains a spectator has to stand up and unroll the poncho before he or she can put on the poncho.

Therefore there is a need for a combination of poncho and cushion that is easy to transport and that can be quickly converted for use as a poncho. There is a further need for such a combination that facilitates a spectator's ability to sit on the cushion.

SUMMARY OF THE INVENTION

The present invention is directed to a combination of a poncho and a padded cushion. A poncho is generally a protective garment for human use. The garment includes a sheet of waterproof material with a hood having a drawstring attached to the sheet. The padded cushion includes a cover, a soft block inside the cover, and an extension sheet attached to the cover. A strip of fastener is attached to one side of the free end of the extension sheet and another strip of fastener is attached to one side of the cover.

The protective garment protects a wearer and the cushion while the wearer is wearing the poncho. For storage, the protective garment can be folded and rolled into the extension sheet. The extension sheet is rolled toward the padded cushion until the strip of fastener on the extension sheet is attached to the strip of fastener on the cover.

Accordingly, it is an object of the invention to provide a combination of cushion and poncho so that the poncho can be quickly put on while a user is still able to remain seated on the cushion. Another object of the invention is to provide a combination of cushion and poncho so that when the poncho is in use it would protect a user and a cushion from the rain, snow or other foul weather element.

Another object of the invention is to provide a combination of cushion and poncho so that a user may be able to wear the poncho while the user is commuting without worry about misplacing the cushion. Another object of the invention is to provide a combination of cushion and poncho so that the poncho is easily folded or rolled for storage.

Other benefits and certain objects of the invention will become apparent upon consideration of the following written description and associated figures.

DETAILED DESCRIPTION OF THE PREFERRED EMBODIMENTS

Figure 1:
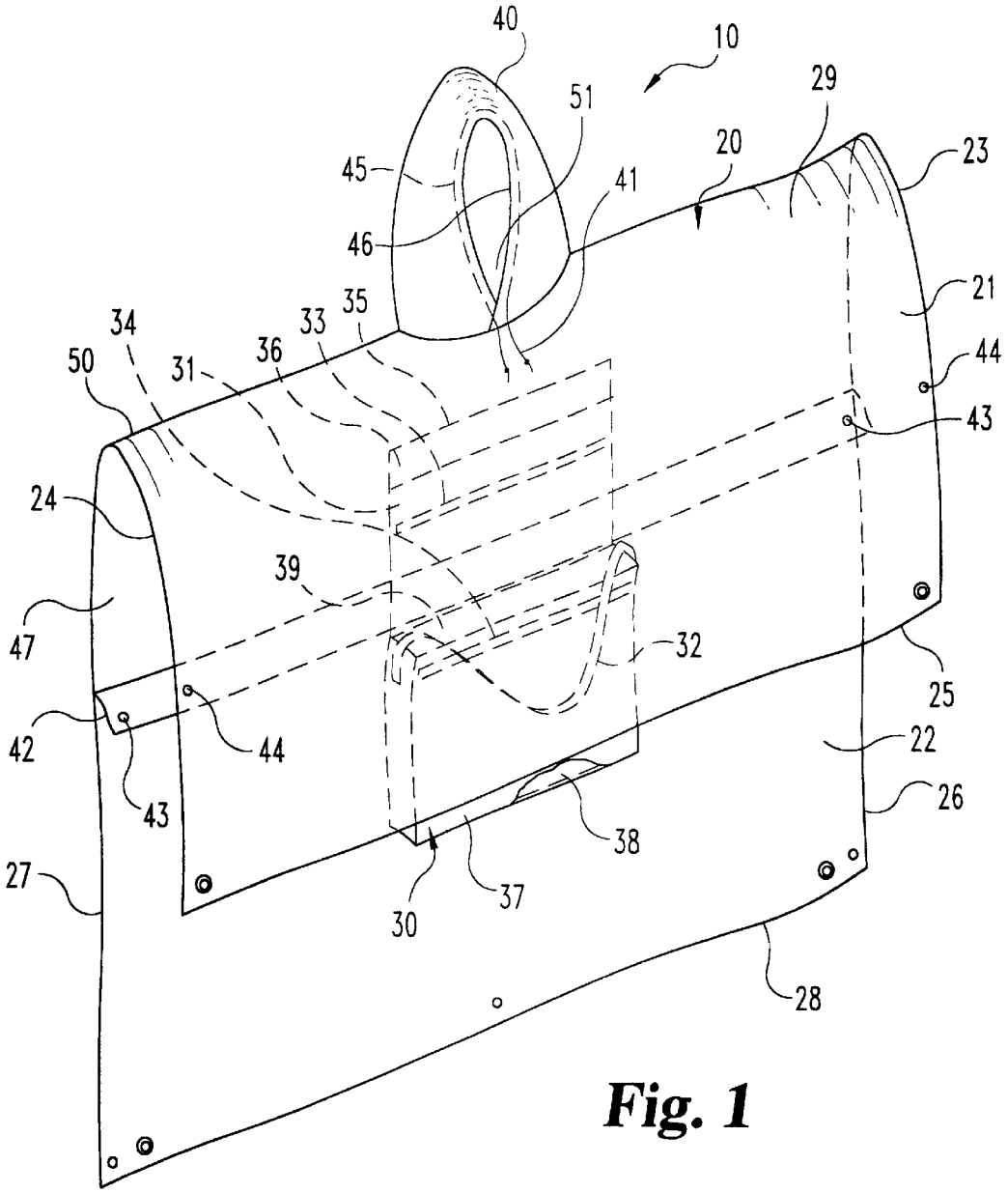
FIG. 1 is a front perspective view of a poncho and cushion combination in accordance with one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

Referring to FIG. 1, a poncho and cushion combination 10 includes a poncho 20 configured for a spectator to wear and a cushion 30 for the person to sit on. The poncho 20 includes a generally rectangular sheet 29 of waterproof material, such as vinyl. The sheet 29 is folded along a transverse line 50 between a front edge 25 and a rear edge 28 to form a front panel 21 and a rear panel 22. Front side edges 23 and 24, rear side edges 26 and 27 and edges 25 and 28 combine to make up the border of the front and rear panels 21 and 22.

An opening 51 is formed in the sheet 29 at a mid-point along the transverse line 50. The opening 51 is sized to receive the head of the spectator. A hood 40 is preferably attached to the sheet 29 around the opening 51. When a spectator is wearing the poncho 20, the transverse line 50 will rest on the shoulders of the spectator and the hood 40 may be either over the wearer's head or resting against the rear panel 22. A drawstring 41 is preferably threaded through a channel 45 formed along the inside edge 46 of the front of the hood 40. The drawstring 41 is used by a wearer to minimize the hood opening to prevent the elements from coming inside the hood opening.

In a further feature of the invention, the cushion 30 is attached to the inside surface 47 of rear panel 22. The location of the attachment of the cushion 30 is such that a wearer can sit on the cushion 30 and still be able to wear the poncho 20 comfortably. For this reason it is important that the location of the cushion 30 be approximately below the buttocks of a spectator when the spectator is at a standing position. When the spectator sits down the cushion 30 will then be perfectly aligned for sitting.

Cushion 30 can include a foam block 38 inside a waterproof cover 37. Preferably the cover 37 is formed of vinyl. The foam block 38 is configured to provide adequate cushion against a hard stadium seat. Other cushioning elements or materials can be housed within the cover 37. The cover 37 can be zippered to allow removal of the foam block 38.

Figure 5:
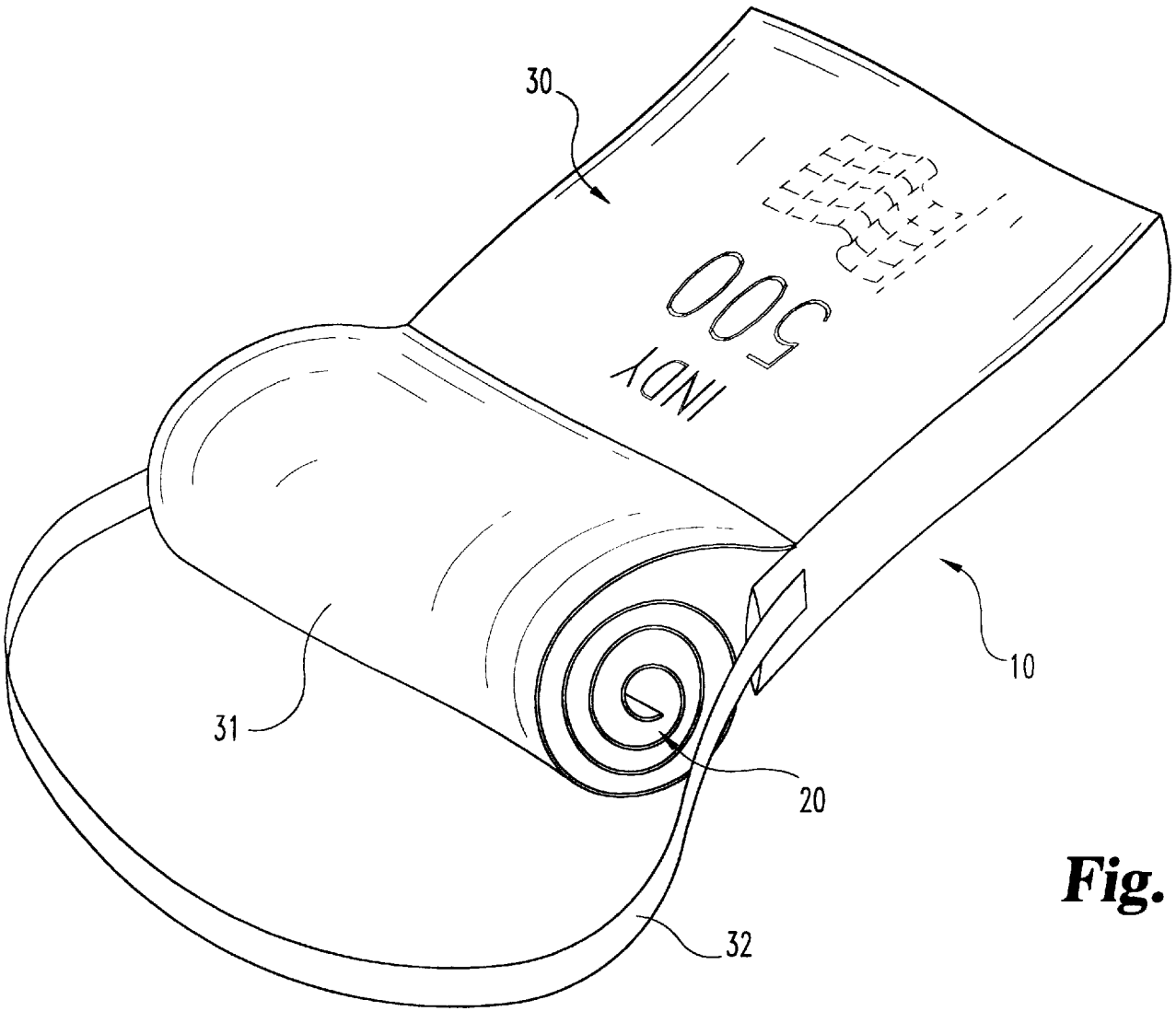
FIG. 5 is a perspective view of the poncho and cushion combination with the poncho in its storage position ready for transport.

A sheet 31 is attached to the inside surface 47 of rear panel 22 along edge 35 of sheet 31. The sheet 31 is also attached to the cover 37 at opposing edge 39. The sheet 31 is preferably sewn to the rear panel 22 and cover 37; however, other forms of attachment are contemplated, such as zippered, buttons, snapped, etc. A fastener strip 33 is attached to one side of sheet 31 facing the inside surface 47 of rear panel 22. Another fastener strip 34 is attached to the seating side of the cushion 30. These two fastener strips can be engaged together to fasten the sheet 31 when the poncho 20 is in the storage position inside of sheet 31 as depicted in FIG. 5. Preferably the fastener strips 33 and 34 are mating hook and loop fasteners.

A strap 32 can be attached to the sides of the cushion 30 for carrying the poncho and cushion combination while the poncho 20 is stowed away.

A row of snap fasteners 43 can be attached to a flap 42 running from left to right on the inside surface 47 of the rear panel 22. The flap 42 is part of the rear panel 22 and it is used to reinforce the attachment of snap fasteners to the flap 42. Sleeves for the poncho are created when fasteners 44 on the front panel 21 are snapped with fasteners 43 on the rear panel 22. Other snap fasteners, can be added to adjust the size of the armholes. In addition, snap fasteners can be added along the side edges 24, 27 and 23, 26 to allow the poncho to be closed on its side.

Figure 2:
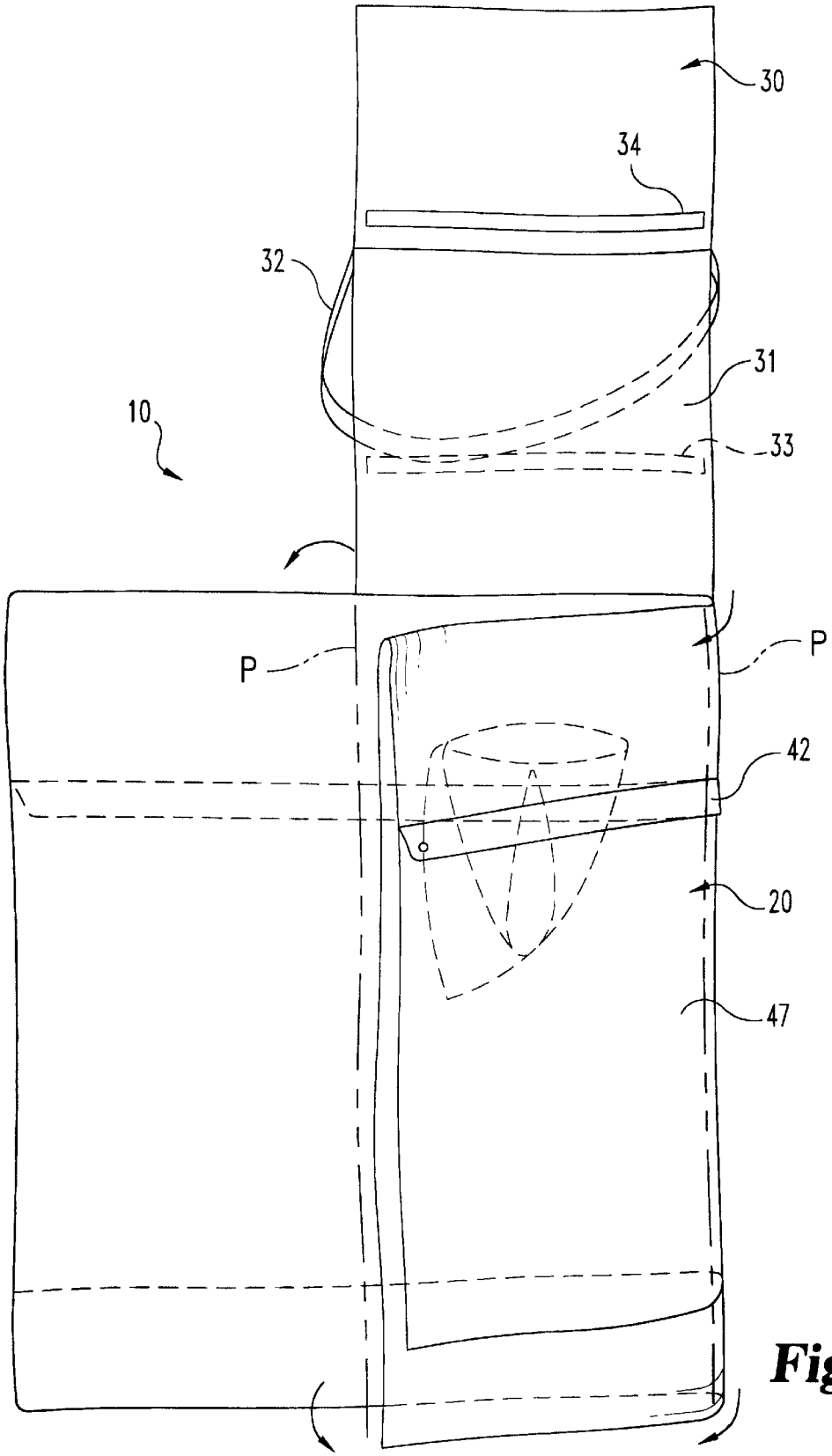
FIG. 2 is a top view of the poncho and cushion combination, depicted in FIG. 1, shown laid on a flat surface with the hood inside and the remainder of the garment being folded for storage.
Figure 3:
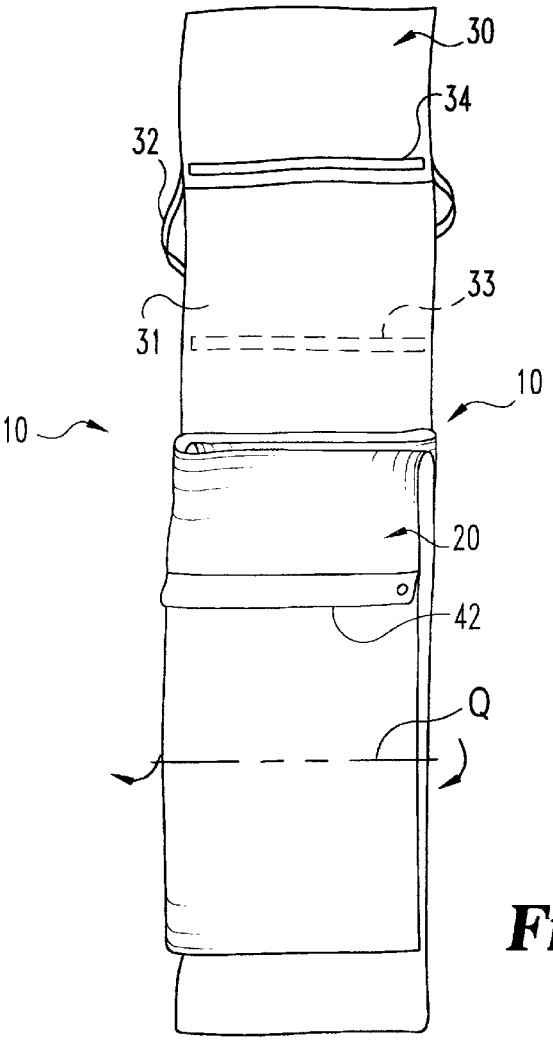
FIG. 3 is a top view of the poncho and cushion combination of FIG. 2 shown in a sequential folded orientation.

One feature of the invention is that the poncho 20 can be folded onto the extension sheet 31 for storage. In a preferred approach, the rectangular sheet 29 is first turned inside out so the hood 23 is inside as depicted in FIG. 2. The edges 23, 24 and 25 of the front panel 21 can be lined up with the corresponding edges 26, 27 and 28 of the rear panel 22, respectively. The left-hand side and right hand side of the rectangular sheet 29 can be folded toward each other along the phantom lines P as shown in FIG. 2. Next the rectangular sheet 29 is folded transversely along the phantom line as shown in FIG. 3.

Figure 4:
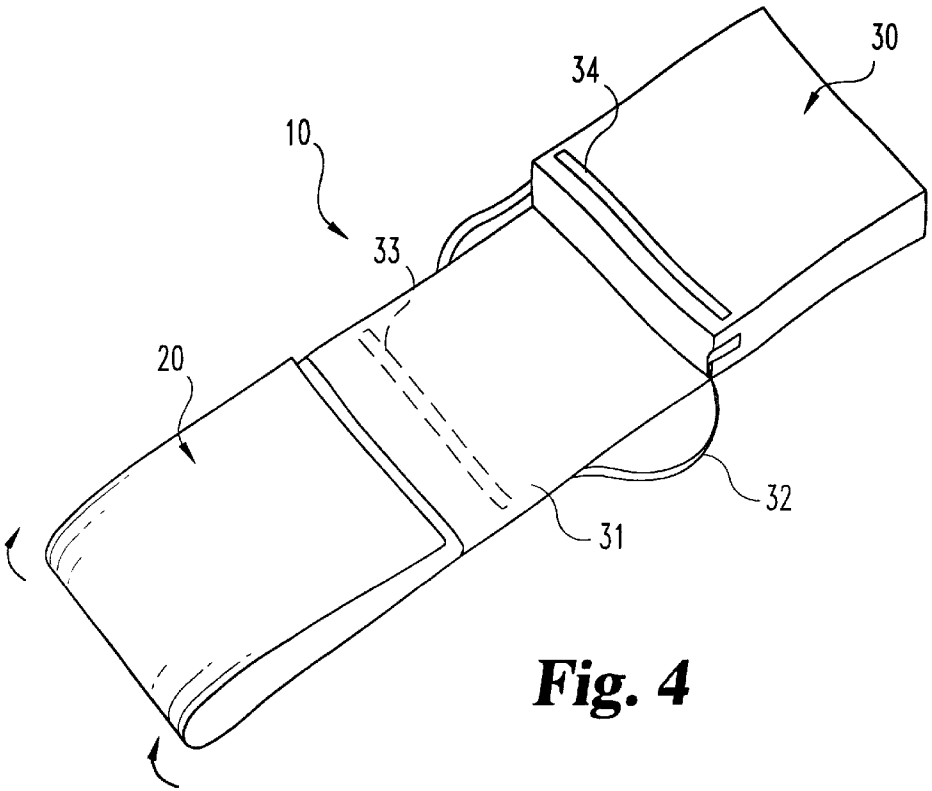
FIG. 4 is a top view of the poncho and cushion combination of FIG. 3 shown in a sequential folded orientation.

With the poncho 20 folded as shown in FIG. 4, the poncho is rolled toward the cushion 30. As the poncho 20 is rolled up, it reaches the extension sheet 31, which is also rolled toward the cushion 30. The poncho 20 and extension sheet 31 is rolled up until the strip fastener 33 on the extension sheet 31 is aligned with strip fastener 34 on the padded cushion 30 as shown in FIG. 5. The poncho and cushion combination 10 is now ready for transport. A user may carry the combination poncho and cushion 10 by using the handle strap 32 slung over the user's shoulder.

Whenever the weather becomes bad, the poncho 20 can be deployed in reverse order of the steps just described. Thus, a spectator can simply unfasten the attachment between the fasteners 33 and 34, unroll the poncho 20 and put the poncho 20 on within seconds. This process can be easily accomplished while the spectator is sitting on the cushion 30.

Another beneficial feature of the invention is that the cushion 30 is disposed on the inside of the poncho 20. When the poncho 20 is unrolled and deployed, the rear panel 22 is situated between the cushion 30 and the seating surface. The poncho thus protects not only the spectator but also the cushion from the elements. With the present invention the spectator no longer suffers from a wet cushion.

Moreover, the placement of the cushion 30 allows the spectator to walk about wearing the poncho 20. The cushion 30 is not only automatically carried with the poncho 20, it is concealed from view and from the elements by the poncho 20.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A combination comprising:

a sheet configured for wearing as a protective garment and including a rear panel;

a padded cushion attached to an inside surface of said rear panel of said protective garment for a user to sit on while wearing said protective garment;

an extension sheet having an end attached to said sheet;

a hood attached to said protective garment for covering the head of said user;

a handle attached to said padded cushion for carrying said combination;

a first strip of hook and loop fastener attached to a rear surface of said extension sheet; and a second strip of hook and loop fastener attached to one side of said cushion so that said first and second strips cooperate to retain said garment folded and rolled into said extension sheet when said extension sheet is rolled toward said cushion.

2. A combination comprising:

a protective garment wearable by a person and a rear panel;

a cushion;

an extension sheet attached at one end to an inside surface of said rear panel and at an opposite end to said cushion, said extension sheet having a length from said one end to said opposite end, said length sized to wrap around said protective garment as said garment is stored within said extension sheet; and a fastener for fastening said opposite end of said extension sheet to said cushion when said protective garment is stored within said extension sheet.

3. The combination of claim 2, further comprising a handle attached to said cushion.

4. The combination of claim 2, wherein said fastener includes a first fastener attached to said extension sheet adjacent said one end, and a second fastener attached to said cushion.

5. The combination of claim 4, wherein said first and second fasteners include complementary hook and loop fasteners.

6. The combination of claim 5, wherein:

said extension sheet has an outer surface facing said rear panel;

said cushion is attached to said extension sheet at an upper end of said cushion;

said first fastener is attached to said outer surface of said extension sheet; and said second fastener is attached to said cushion at said upper end thereof.

7. The combination of claim 5, wherein:

said extension sheet has a width adjacent said one end; and said first and second fasteners include strips of complementary hook and loop fasteners, said strips having a length substantially equal to said width.

8. The combination of claim 2, wherein said protective garment is a poncho having a front panel attached to said rear panel and defining an opening between said front panel and said rear panel for receiving the head of the person therethrough.

9. The combination of claim 8, wherein said poncho includes a hood for covering the head of the person.

10. The combination of claim 2, wherein said extension sheet is attached to said rear panel of said protective garment so that said cushion is entirely within said protective garment when the garment is worn by the person.

11. The combination of claim 2, wherein said cushion is a padded cushion.

* * * * *